US008114337B2

(12) United States Patent
Goodman et al.

(10) Patent No.: US 8,114,337 B2
(45) Date of Patent: Feb. 14, 2012

(54) LANCE EXTRACTION

(75) Inventors: Neil John Goodman, Ardross (AU); Ian William Beaumont, Shelley (AU); Stephen Prendergast, Wembly (AU); Trevor Williams, Boweya Via Glenrowan (AU)

(73) Assignee: Technological Resources Pty. Limited, Melbourne (AU)

( * ) Notice: Subject to any disclaimer, the term of this patent is extended or adjusted under 35 U.S.C. 154(b) by 686 days.

(21) Appl. No.: 11/885,501

(22) PCT Filed: Mar. 1, 2006

(86) PCT No.: PCT/AU2006/000262

§ 371 (c)(1),
(2), (4) Date: Jan. 30, 2009

(87) PCT Pub. No.: WO2006/092010

PCT Pub. Date: Sep. 8, 2006

(65) Prior Publication Data

US 2009/0127752 A1 May 21, 2009

(30) Foreign Application Priority Data

Mar. 2, 2005 (AU) ..... 2005900986

(51) Int. Cl.
*C21B 13/00* (2006.01)
*C21B 15/00* (2006.01)
*C21C 5/32* (2006.01)

(52) U.S. Cl. ..... 266/44; 266/225

(58) Field of Classification Search ..... 266/44, 266/225

See application file for complete search history.

(56) References Cited

U.S. PATENT DOCUMENTS

| | | | | |
|---|---|---|---|---|
| 4,533,125 | A | 8/1985 | Mailliet et al. | |
| 5,167,904 | A | 12/1992 | Stomp et al. | |
| 5,200,136 | A * | 4/1993 | Ramaseder et al. | 266/79 |
| 5,374,296 | A | 12/1994 | Jones | |
| 6,565,798 | B2 | 5/2003 | Gurr et al. | |

FOREIGN PATENT DOCUMENTS

| | | | |
|---|---|---|---|
| EP | 0 075 980 | B1 | 12/1984 |
| WO | WO 2006/010208 | A1 | 2/2006 |

* cited by examiner

*Primary Examiner* — Jessica L Ward
*Assistant Examiner* — Alexander Polyansky
(74) *Attorney, Agent, or Firm* — Finnegan, Henderson, Farabow, Garrett & Dunner, L.L.P.

(57) ABSTRACT

Solids injection lances for injecting solids into a metallurgical vessel are normally supplied with cooling water from a cooling water circuit through water supply lines and return lines. Supply lines are provided with spaced pairs of connectors and bypass valves, and return lines are provided with similar pairs of spaced connectors and bypass valves. Flexible hoses can be connected between the pairs of connectors to establish supply and return flows of cooling water which bypass segments of the main supply and return lines which can be isolated and removed to allow withdrawal and subsequent replacement of the lances.

16 Claims, 8 Drawing Sheets

LANCE EXTRACTION

TECHNICAL FIELD

The present invention relates to the removal and replacement of solids injection lances from metallurgical vessels. The lances may be used for injecting gaseous and/or solids materials into the metallurgical vessels. In one particular application such lances may be used for injecting metallurgical feed material into the molten bath of a smelting vessel for producing molten metal, for example by a direct smelting process.

A known direct smelting process, which relies on a molten metal layer as a reaction medium, and is generally referred to as the HIsmelt process, is described in International application PCT/AU96/00197 (WO 96/31627) in the name of the applicant.

The HIsmelt process as described in the International application comprises:

(a) forming a bath of molten iron and slag in a vessel;

(b) injecting into the bath;

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$, released from the bath in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solid material into the metal layer in the bottom of the vessel. The lances must withstand operating temperatures of the order of 1400° C. within the smelting vessel. The lances must accordingly have an internal forced cooling system to operate successfully in this harsh environment and must be capable of withstanding substantial local temperature variations.

U.S. Pat. No. 6,398,842 discloses one form of lance which is able to operate effectively under these conditions. In that construction the solid particulate material is passed through a central core tube which is fitted closely within an outer annular cooling jacket, the forward end of the core tube extending through and beyond the forward end of the cooling jacket into the metallurgical vessel. Australian Patent Application 2004906032 provides a modification in which the central core tube and the outer annular water jacket are held in spaced apart relationship and in which a purge gas can be passed between them. This construction better accommodates differential expansion movements between the central tube and the outer jacket and also prevents the front end of the lance from becoming clogged with slag.

The metallurgical vessel for performing the HIsmelt process presents unique problems in that the process operates continuously, and the vessel must be closed up as a pressure vessel for long periods, typically of the order of a year or more and then must be quickly relined in a short period of time as described in U.S. Pat. No. 6,565,798 in the name of the applicant.

Before refurbishment of the vessel can proceed it is necessary to extract all of the solids injection lances from the vessel and remove them to a safe location. Moreover, individual lances may need to be withdrawn for repair and/or replacement between major refurbishments of the vessel. The present invention provides a procedure for removing and replacing the solids lances while maintaining a temporary cooling water supply to the lances during this procedure, this enabling the lances to be withdrawn and replaced while the smelting vessel remains in a hot condition.

DISCLOSURE OF THE INVENTION

According to the invention there is provided a method of removing from a metallurgical vessel an internally water cooled injection lance to which gaseous and/or solids material is supplied through an injection supply line to an outer end of the lance and to which cooling water is normally supplied from a cooling water circuit through a water supply line connected between the cooling water circuit and the lance and returned to the cooling water circuit via a return line connected between the lance and the cooling water circuit, comprising the steps of:

connecting a first flexible hose between a pair of water supply line connection locations spaced along the water supply line and establishing a flow of cooling water through that hose to the lance which bypasses a segment of the water supply line between said water supply line connection locations, connecting a second flexible hose between return line connection locations spaced along the return line to establish a return flow of water from the lance which bypasses a segment of the return line between the return line connection locations, isolating at least a part of each of said segments of the delivery line and the return line from both the cooling water circuit and the lance, disconnecting at least a portion of the isolated parts of the water supply line and the return line, disconnecting at least a portion of the injection supply line, and removing the lance from the vessel while maintaining the flow of cooling water through the lance via the flexible hoses.

Preferably at least a portion of the segments disconnected from the water supply and return lines are removed.

Preferably at least a portion of the injection supply line is removed and more preferably the delivery end of that line is disconnected and removed from the lance.

The lance may be a solids injection lance in which case the injection supply line may be a solids conveyor.

Alternatively, the lance may be for the purpose of injecting gaseous material into the vessel in which case the injection supply line may be a gas supply duct.

There may be ancillary water flow connections to the lance and/or the delivery end of the injection supply line and in this case the method may include the step of disconnecting one or more of those connections to permit withdrawal of the lance. In particular there may be connections for flow of cooling water to a lance mounting flange by which the lance is mounted on the vessel and this may be disconnected prior to withdrawal of the lance.

Alternatively, ancillary water flow connections extend between main sections of the water supply and return lines and form at least one sub-circuit for supply of cooling water to cooling circuits of the lance. Said sub-circuit may form a sub-assembly connected to the lance and is preferably a self-supporting sub-assembly. The main sections of the water supply and return lines may locate isolation valves which in use operate to isolate the at least one sub-circuit from the supply and return lines. The supply and return lines and the at least one sub-circuit may be adapted to receive and locate hoses on either side of the isolation valves whereby in use temporary cooling water by-passes the isolation valves and is supplied to the at least one sub-circuit.

There may also be a water flow connection for supply of water to a flange connecting the delivery end of the injection supply line to the upper end of the lance which may also need to be disconnected prior to withdrawal of the lance.

There may also be a purge gas connector for admission of purge gas into the lance for flow between a central core tube and an annular cooling jacket of the lance. In this case the purge gas connector may also need to be disconnected prior to removal of the lance.

The invention also includes replacing the lance by the steps of establishing a flow of cooling water to the replacement lance through said flexible hoses, inserting the lance into the vessel, reinstalling the isolated parts of the supply line and the return line and de-isolating those parts to establish a flow of cooling water through those parts of the supply and return lines, and disconnecting the flexible hoses.

BRIEF DESCRIPTION OF THE DRAWINGS

In order that the invention may be more fully explained, an embodiment will be described in some detail with reference to the accompanying drawings in which.

DETAILED DESCRIPTION OF THE PREFERRED EMBODIMENT

Figure 1:
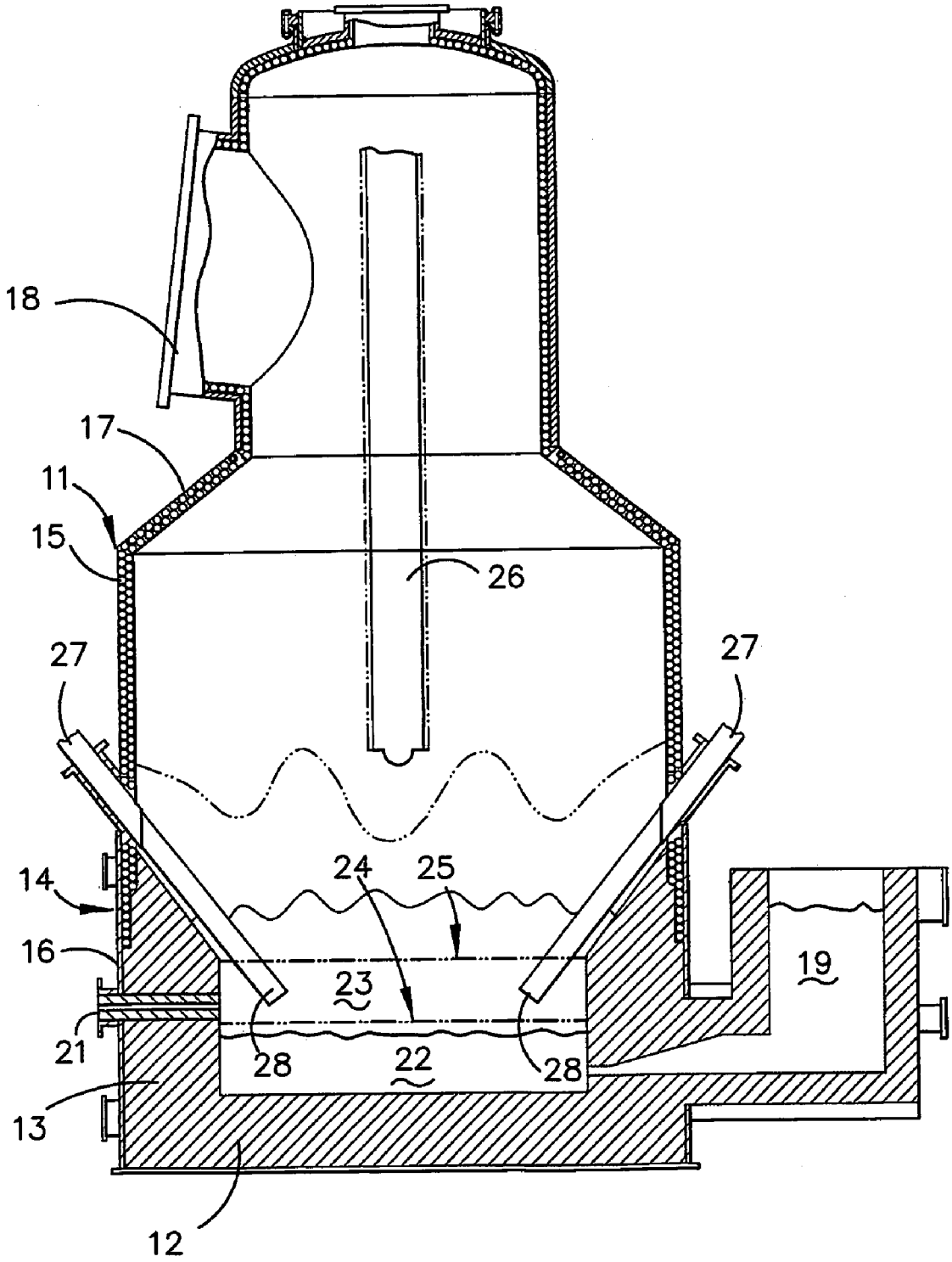
FIG. 1 is a vertical cross section through a metallurgical vessel incorporating solids injection lances.

FIG. 1 illustrates a direct smelting vessel suitable for operation by the HIsmelt process as described in International Patent Application PCT/AU96/00197. The metallurgical vessel is denoted generally as 11 and has a hearth that includes a base 12 and sides 13 formed from refractory bricks; side walls 14 which form a generally cylindrical barrel extending upwardly from the sides 13 of the hearth and which includes an upper barrel section 15 and a lower barrel section 16; a roof 17; an outlet 18 for off-gases; a forehearth 19 for discharging molten metal continuously; and a tap-hole 21 for discharging molten slag. The vessel is located on a strong foundation so as to be firmly fixed in position during operation of the HIsmelt process. The roof of the vessel is thus in a fixed location when the process is operational.

In use, the vessel contains a molten bath of iron and slag which includes a layer 22 of molten metal and a layer 23 of molten slag on the metal layer 22. The arrow marked by the numeral 24 indicates the position of the nominal quiescent surface of the metal layer 22 and the arrow marked by the numeral 25 indicates the position of the nominal quiescent surface of the slag layer 23. The term "quiescent surface" is understood to mean the surface when there is no injection of gas and solids into the vessel.

The vessel is fitted with a downwardly extending hot air injection lance 26 for delivering a hot air blast into an upper region of the vessel and a series of solids injection lances 27 extending downwardly and inwardly through the side walls 14 and into the slag layer 23 for injecting iron ore, solid carbonaceous material, and fluxes entrained in an oxygen deficient carrier gas into the metal layer 22. The position of the lances 27 is selected so that their outlet ends 28 are above the surface of the metal layer 22 during operation of the process. This position of the lances reduces the risk of damage through contact with molten metal and also makes it possible to cool the lances by forced internal water cooling without significant risk of water coming into contact with the molten metal in the vessel.

Lances 27 may be of two kinds, a first of which is employed to inject hot ore material and the other of which is employed to inject carbonaceous material such as coal. There may for example be eight solids injection lances 27 spaced circumferentially around the vessel and consisting of a series of four hot ore injection lances and four coal injection lances spaced between the hot ore injection lances. All of the lances may fit within outer housings of a common construction but the two kinds of lance have differing interior construction tubes because of the vastly different temperature of the hot ore and the coal being injected. The lances receive the solids materials from a series of solids conveyors, which typically are pneumatic conveyors and which typically have spools 30 connected to the outer ends of the lances. The spools of the hot ore conveyors may be water cooled and supplied with cooling water in the manner described below.

Figure 2:
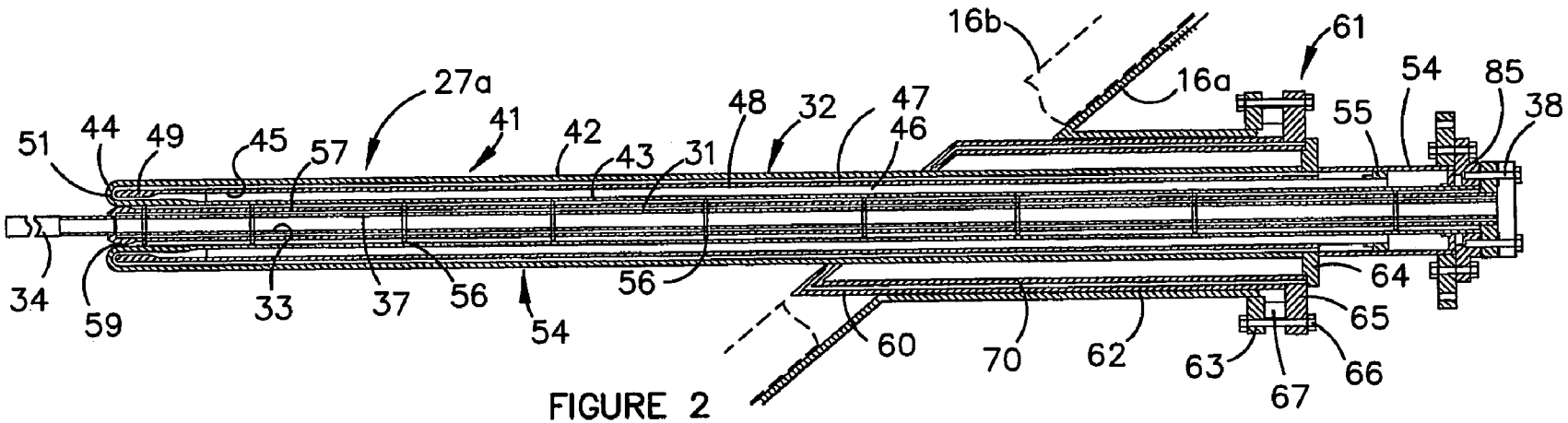
FIG. 2 is a longitudinal cross-section through one of the solids injection lances for injecting coal into the vessel.
Figure 3:
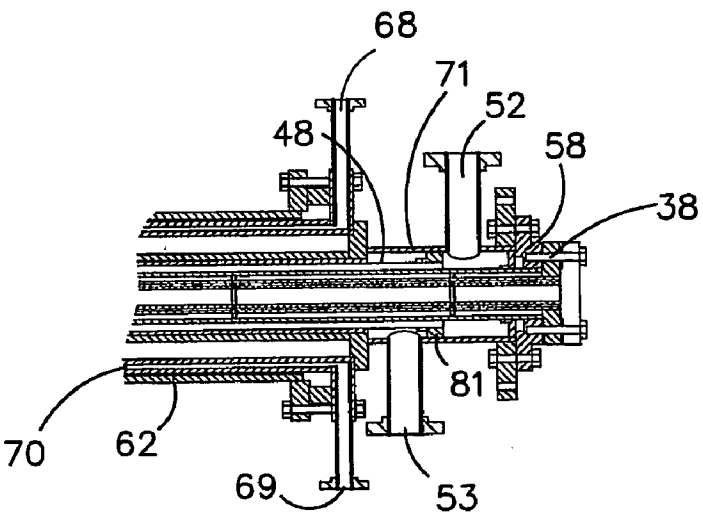
FIG. 3 is a cross-section through a rear part of the lance shown in FIG. 2.

The construction of an injection lance for carbonaceous material, identified as 27*a*, is illustrated in FIGS. 2 to 3. As shown in these figures lance 27*a* comprises a central core tube 31 through which to deliver the solids material and an annular cooling jacket 32 surrounding the central core tube 31 throughout a substantial part of its length. Central core tube 31 is formed of low carbon steel tubing 33 throughout most of its length but its forward end is fitted with a replaceable extension or nozzle tube 34 which projects as a nozzles from the forward end of the cooling jacket 32.

Central core tube 31 is internally lined through to the forward end part 34 with a ceramic lining 37 formed by a series of cast ceramic tubes. The rear end of the central core tube 31 is connected through a coupling 38 to a coal delivery system through which particulate coal is delivered in a pressurised fluidising gas carrier, for example nitrogen.

Annular cooling jacket 32 comprises a long hollow annular structure 41 comprised of outer and inner tubes 42, 43 interconnected by a front end connector piece 44 and an elongate tubular structure 45 which is disposed within the hollow annular structure 41 so as to divide the interior of structure 41 into an inner elongate annular water flow passage 46 and an outer elongate annular water flow passage 47. Elongate tubular structure 45 is formed by a long carbon steel tube 48 welded to a machined carbon steel forward end piece 49 which fits within the forward end connector 44 of the hollow tubular structure 41 to form an annular end flow passage 51 which interconnects the forward ends of the inner and outer water flow passages 46, 47. The rear end of annular cooling jacket 32 is provided with a water inlet 52 through which a flow of cooling water can be directed into the inner annular water flow passage 46 and a water outlet 53 from which water is extracted from the outer annular passage 47 at the rear end of the lance. Accordingly in use of the lance cooling water flows forwardly down the lance through the inner annular water flow passage 46 then outwardly and back around the forward annular end passage 51 into the outer annular passage 47 through which it flows backwardly along the lance and out through outlet 53. This ensures that the coolest water is in heat transfer relationship with the incoming solids material and enables effective cooling of both the solids material being injected through the central core of the lance as well as effective cooling on the forward end and outer surfaces of the lance.

The outer surfaces of the tube 42 are machined with a regular pattern of rectangular projecting bosses 54 each having an undercut or dove tail cross section so that the bosses are of outwardly diverging formation and serve as keying formations for solidification of slag on the outer surfaces of the lance. Solidification of slag onto the lance assists in minimising the temperature in the metal components of the lance. It has been found in use that slag freezing on the forward or tip end of the lance serves as a base for formation of an extended pipe of solid material serving as an extension of the lance which further protects exposure of the metal components of the lance to the severe operating conditions within the vessel.

The lance is mounted in the wall of the vessel 11 via a mounting structure 61 comprising a tubular part 60 extended about the cooling jacket and having a double walled construction so as to enclose an annular space 70 between these walls. The tubular part 60 fits within a tubular lance mounting bracket 62 welded to the shell of vessel 11 so as to project upwardly and outwardly from the vessel and provided at its upper end with an end flange 63. Lance mounting structure 61 is connected to the rear end of the outer tube 42 of annular cooling jacket 32 via an annular ring 64 and it also includes an annular mounting flange 65 which can be clamped to the flange 63 at the end of mounting tube 62 via clamping bolts 66. A split spacer ring 67 is fitted between the flanges 63, 65 to hold them apart when the clamping bolts 66 are tightened. The arrangement is such that the forward part of the outer sleeve 60 of structure 61 extend through to the inside of the vessel wall.

The tubular part 60 of mounting structure 61 is water cooled, cooling water being supplied to the interior space 70 through a water inlet 68 and return through a water outlet 69 at the rear end of the mounting sleeve. The interior space 70 may be partitioned to provide an extended cooling water flow passage within it.

A tubular housing 54 extending rearwardly from the mounting ring 64 of mounting structure 61 houses the rear end of the intermediate tube 48 of jacket 32 and the rear end of the core tube 31 of the lance. Housing 54 carries the cooling water inlet 52 and outlet 53 for the passage of cooling water to and from the lance cooling jacket 32. A flexible annular connecting structure 55 connects the rear end of the intermediate tube 48 of the water jacket with the housing tube 54 so as to separate the inward and outward water flow passages within the housing and to also permit relative longitudinal movement between the inner and outer tubes and the intermediate tube of the water jacket due to differential thermal expansion and contraction in the components of the lance.

The rear end of tubular housing 54 provides a mounting for the rear end of the inner tube 43 of the annular cooling jacket.

Core tube 31 is held in spaced apart relationship within annular cooling jacket 32 by a series of spacer collars 56 projecting outwardly from the central core tube at longitudinally spaced locations along the core tube to engage the inner periphery of the inner tube of the annular cooling jacket so as to form an annular gas flow passage 57 between the central core tube and the annular cooling jacket. A purge gas inlet 58 is provided at the rear end of the lance for admission of a purge gas such as nitrogen to be admitted into the gas flow passage 57 to flow forwardly through the lance between the core tube and the annular cooling jacket to exit the lance at the forward end of the cooling jacket.

The central core tube is fitted with a bulbous projection 59 in the region of the forward end of the cooling jacket to provide a controlled nozzle opening between the core tube and the water jacket to control the purge gas flow rate. The spacer collars 56 are formed so as to leave circumferentially spaced gaps between the outer peripheries and the inner periphery of the cooling jacket to allow for free flow of purge gas through the annular purge gas flow passage 57. One of the end collars 56 is located closely adjacent the bulbous projection 86 so as to provide accurate location of that projection within the forward end of the outer cooling jacket so as to create the controlled annular gap for the purge gas exit nozzle. The flow of purge gas is maintained to ensure that slag can not penetrate the forward end of the nozzle between the core tube and the outer water jacket. If slag were to penetrate the lance in this region it would immediately freeze because of the water cooled outer jacket and the cold purge gas.

During operation of the lances slag will accumulate on the outer surfaces of the lance and the inner surface of the vessel. On shutdown the slag will solidify tending to bond the lance to the vessel. However with the illustrated mounting arrangement this bond can readily be broken to facilitate withdrawal of the lance. This can be achieved by loosening the mounting bolts 67 sufficiently to enable withdrawal of the split spacer ring 66. This then permits limited inward movement of the lance mounting sleeve within the mounting tube 62 so that the forward end of the mounting sleeve is moved inwardly from the wall of the vessel to break any slag accretions. This then allows the lance along with the slag that has solidified on the outer tube 42 to be readily withdrawn through the enlarged opening provided for the tubular mounting 60.

Figure 4:
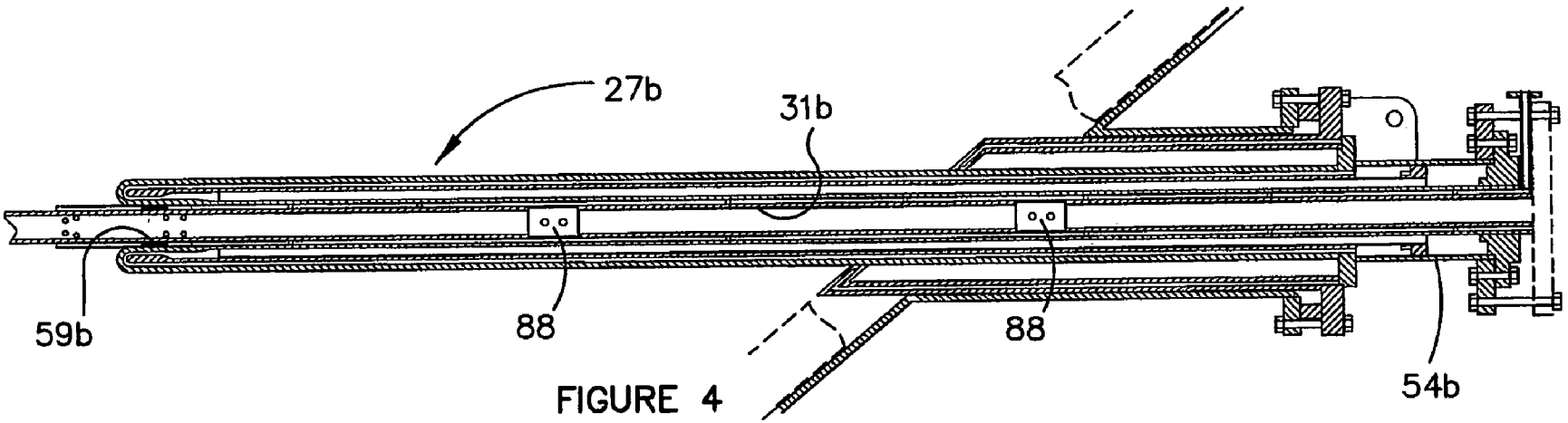
FIG. 4 is a longitudinal cross-section through a lance for injecting hot ore material into the vessel.
Figure 5:
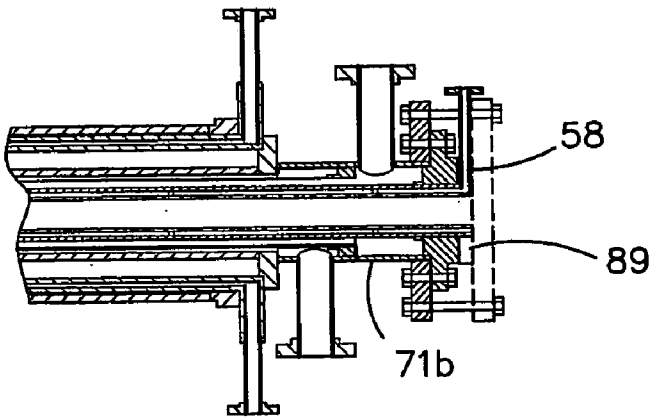
FIG. 5 is a cross-section through a rear part of the lance shown in FIG. 5.

The hot ore injection lances may be of generally similar construction to the coal injection lances. However, as shown in FIGS. 4 and 5, the hot ore lance **27*b* has an inner core tube formed as a thick walled spun cast tube 31*b* with no liner. The tube 31*b* must be made in sections which are joined by split joining sleeves 88. Adjacent tubes can be aligned and connected through the joining sleeves by stitch welding. The forward end of the core tube 31*b* is provided with a projection 59*b*** to set the size of the purge gas outlet nozzle. Because of the thicker core nozzle tube in the hot ore injection lance this projection is much smaller than the more bulbous projection of the coal delivery lance.

In a further modification, the hot ore injection lance is provided with a water cooled flange 89 to stop overheating of the housing tube 51*b*. This flange is sandwiched between the water cooled end flange of the lance housing and the flange on the end of the ore injection system which may also be water cooled.

The inner core tube of the hot ore injection lance is held in spaced apart relationship within the cooling jacket by a series of spacer collars projecting outwardly from the central core tube in the same fashion as in the coal lance construction. As in the coal lance, the space between the inner core tube and the water jacket provides an annular passage for flow of purge gas which exits the lace at the forward end of the cooling jacket.

The outer mountings for the two kinds of injection lance are identical so that both kinds of injection lances can be inserted into a common design housing.

The solids injection lances 27*a* and 27*b* can be removed and replaced while maintaining a temporary cooling water supply to the lances during this procedure. In essence the procedure requires that the lance be isolated from a main cooling water supply circuit. The isolation points are bypassed by flexible hoses that maintain the supply of cooling water to the lance. Once the isolation points are bypassed a part of the cooling water supply line is disconnected and/or removed. This breaks the physical connection between the lance and the cooling water supply circuit and allows the lance to be removed. The flexible hoses remain in place during extraction of the lance so as to maintain cooling water supply through this procedure. It is therefore possible to remove and replace a lance whilst the vessel contains molten material.

Figure 6:
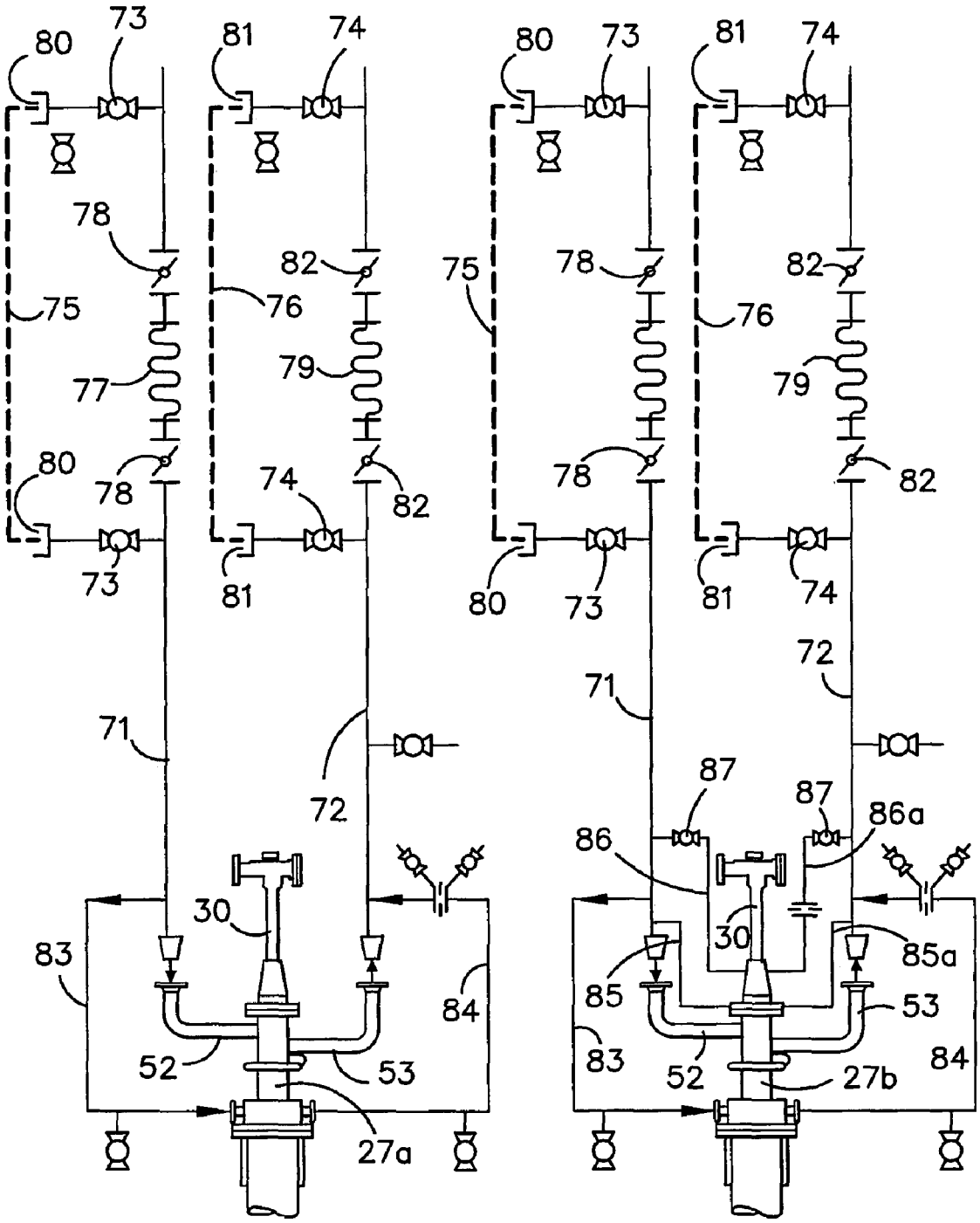
FIG. 6 diagrammatically illustrates relevant components of the coal and hot-ore injection lances and the cooling water connections for those lances.

As shown in FIG. 6 the cooling water inlets 52 and outlets 53 for the lances 27*a* and 27*b* are connected to a main cooling water circuit via supply lines 71 and return lines 72. The supply lines 71 are provided with spaced pairs of connectors 80 and by pass valves 73 and return lines 72 are provided with similar pairs of spaced connectors 81 and bypass valves 74. A flexible hose 75 can be connected between the pair of connectors 80 and another flexible hose 76 connected between the pair of connectors 81 to establish supply and return flows of cooling water which bypass segments of the main supply and return lines between the connectors 80 and 81. Between the pair of connectors 80 the supply line 71 includes a flexible coupling 77 disposed between a pair of isolation valves 78. Similarly return line 72 includes a flexible coupling 79 disposed between a pair of isolation valves 82.

The water cooled mounting sleeves 70 for the lances 27*a*, 27*b* are provided with cooling water through ancillary supply and return lines 83, 84. Further ancillary supply and return lines 85, 85*a* 86 and 86*a* provide for flow of cooling water through the spool 30 of the hot ore delivery conveyer and through flanges connecting that spool to the rear end of lance 27*b*. Auxiliary lines 86, 86*a* incorporate two cooling water isolation valves 87.

Figure 7:
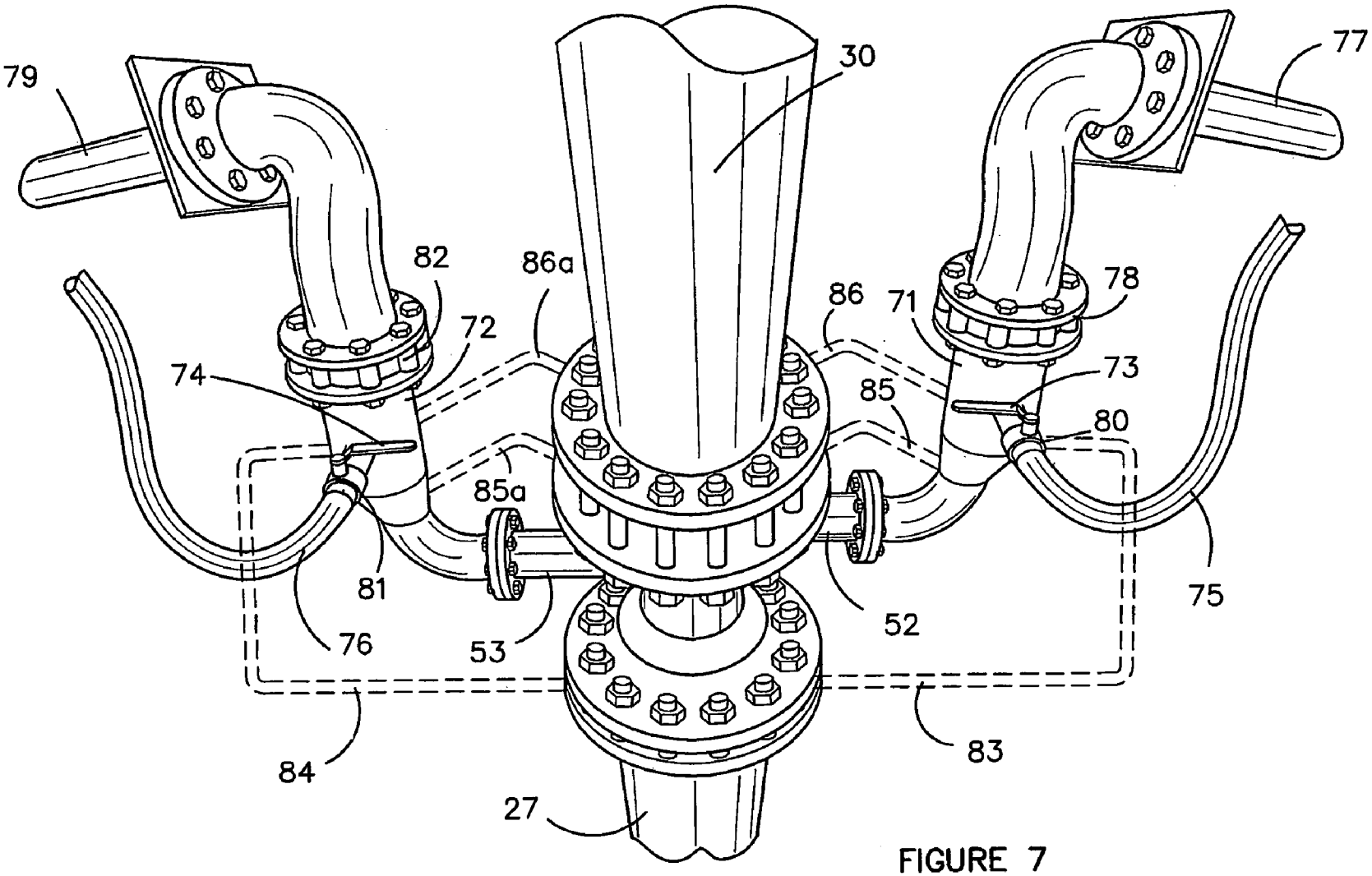
FIG. 7 illustrates the physical layout of the cooling water connections for one of the hot ore injection lances.

The ancillary supply and return lines extend between sections of the primary supply and return lines and form one or more sub-circuit for supply of cooling water to individual cooling circuits or water cooled elements within the lance as indicated by the pipework shown in dotted outline in FIG. 7. The sub-circuits form at least one sub-assembly of ancillary water flow connections extending from the lance. The sub-circuits may be self-supporting. The sub-circuits are isolated by operation of isolation valves 78 & 82 on the main supply and return lines and are adapted to receive cooling water from hoses 75, 76 connected to by-pass valves 73, 74. By forming at least one sub-assembly the sub-circuits can be retained on the lance as the lance is installed or extracted from the vessel. This enables the supply of cooling water to be maintained to the lance during installation or removal.

When removing one of the lances 27*a* or 27*b* the flexible hoses are connected between the connectors 73 and a flow of cooling water for the lance is established through the temporary hoses to bypass the segments of the supply and return lines 71, 72 which incorporate the flexible couplings 77 and 79. The isolation valves 78, 82 can then be actuated to isolate these parts of the supply and return lines which can then be removed to allow withdrawal of the lance.

A typical lance withdrawal sequence of operations may be as follows:

- Cease supply of solids to vessel
- Cease operation of the hot air blast
- Drain slag
- Open pressure valves in off-gas hood to establish negative pressure in vessel (this is to prevent an updraft of hot air and potentially hazardous gases escaping from the vessel via the lance support nozzle 62 once the lance is removed)
- Connect the flexible hoses 75, 76 so as to bypass cooling water isolation valves 78, 82 in the supply and return lines 71, 72 and open the bypass valves 73, 74 to establish water flow (this preferably includes bleeding of the hoses to prevent air bubbles forming in the water circuit)
- Close isolation valves 78, 82
- Remove the isolated sections of the cooling water supply and return lines (flexible couplings 77, 79)
- Isolate and disconnect nitrogen supply to lance (typically for nitrogen purge)
- Isolate cooling water to flange of hot ore conveying spool 30 if removing a hot ore lance 27*b* (cold lance 27*a* does not have a water cooled flange on its spool)
- Disconnect the spool 30 (delivery end) of the solids conveyor and possibly other upstream components of the solids conveyor
- Break the split lance mounting ring and remove lance, and place a blanking plate on open flange Reducing the slag level in the vessel, for example by performing a slag drain, prior to the coupling of the by-pass hoses to the lance reduces the heat load on the lance arsing from contact with molten slag. This is advantageous where the by-pass hoses supply cooling water at a reduced rate compared to the permanent cooling water circuit.

To subsequently replace the lance, the lance or its substitute is connected to the temporary hoses 75, 76 to establish a flow of cooling water through the cooling jacket of the lance and the lance is inserted into the vessel. Nitrogen purge is established through the lance. The flexible couplings 77, 79 are then reinstalled, the isolation valves 78, 82 are opened and the by-pass valves 73, 74 are closed to establish a cooling water flow to the lance through the main supply and return lines 71, 72 and so enable the flexible hoses to be removed. The ancillary water flow connections are also re-established at this time and the solids conveyor re-connected so as to enable smelting operations to proceed.

Figure 8A:
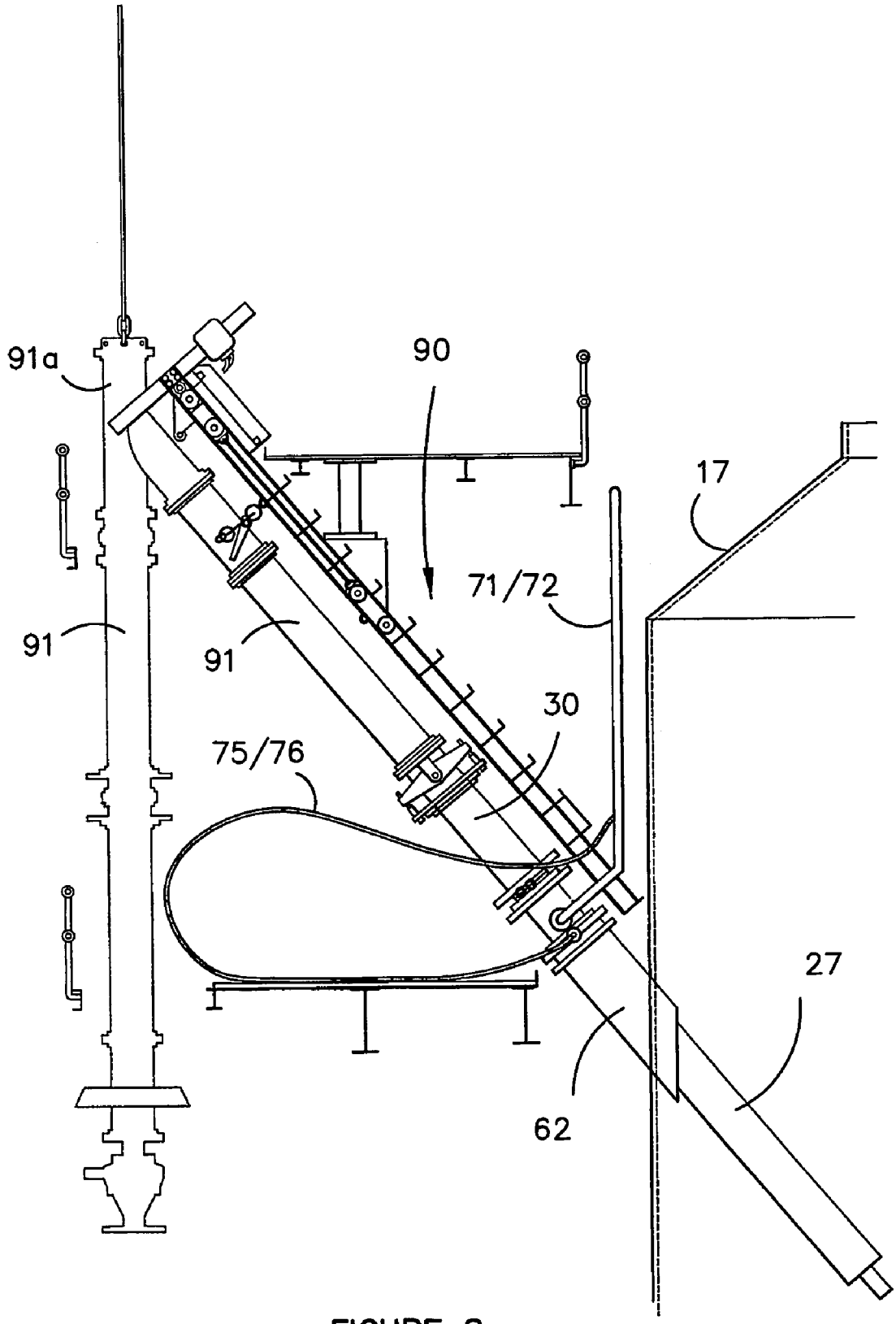
FIG. 8*a* illustrates a lance installed on a smelt reduction vessel and connected to a solids conveyor, temporary cooling water being supplied to the lance by a flexible hose.
Figure 8B:
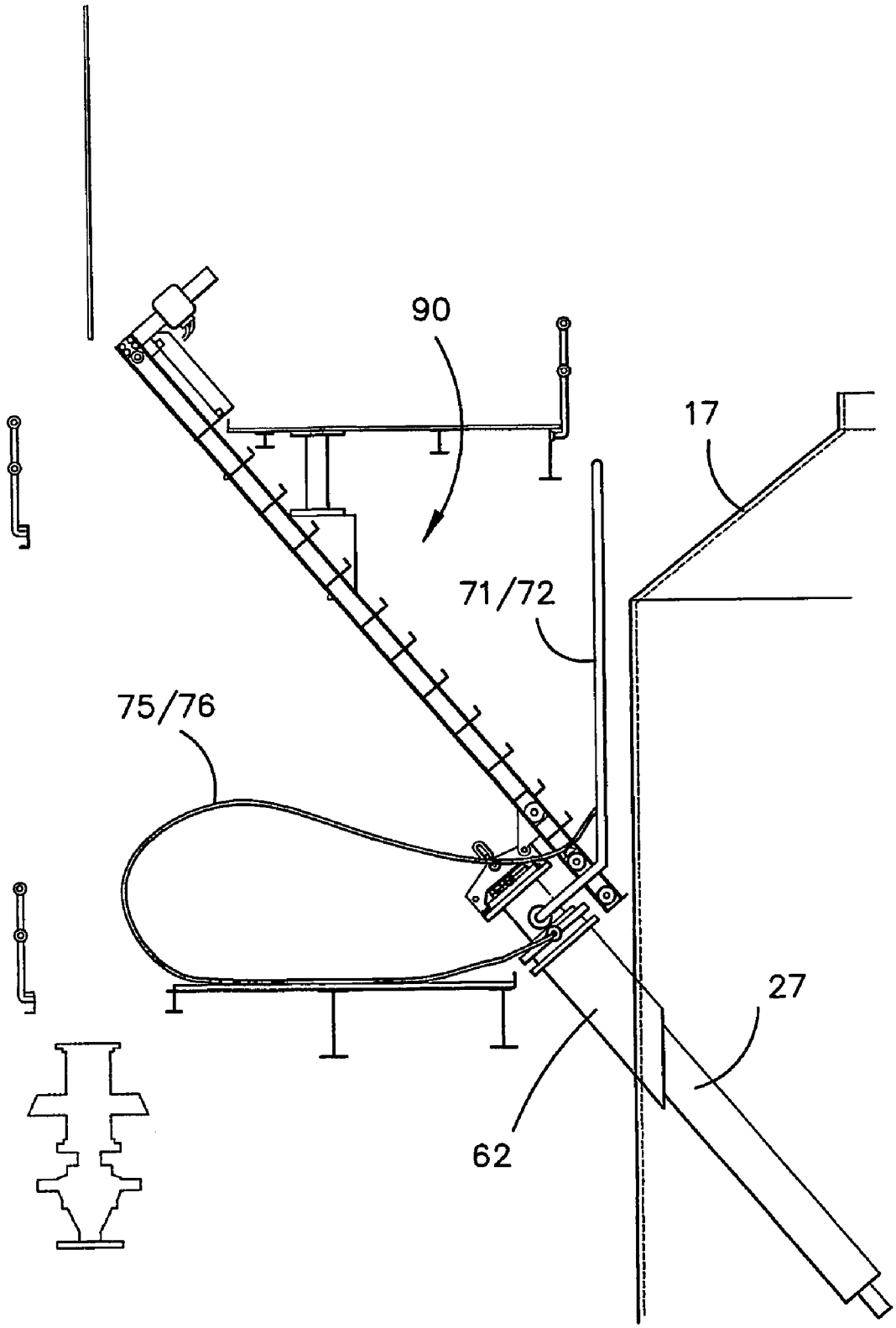
FIG. 8*b* illustrates the lance of FIG. 8*a* with the solids conveyor disconnected from the lance.
Figure 8C:
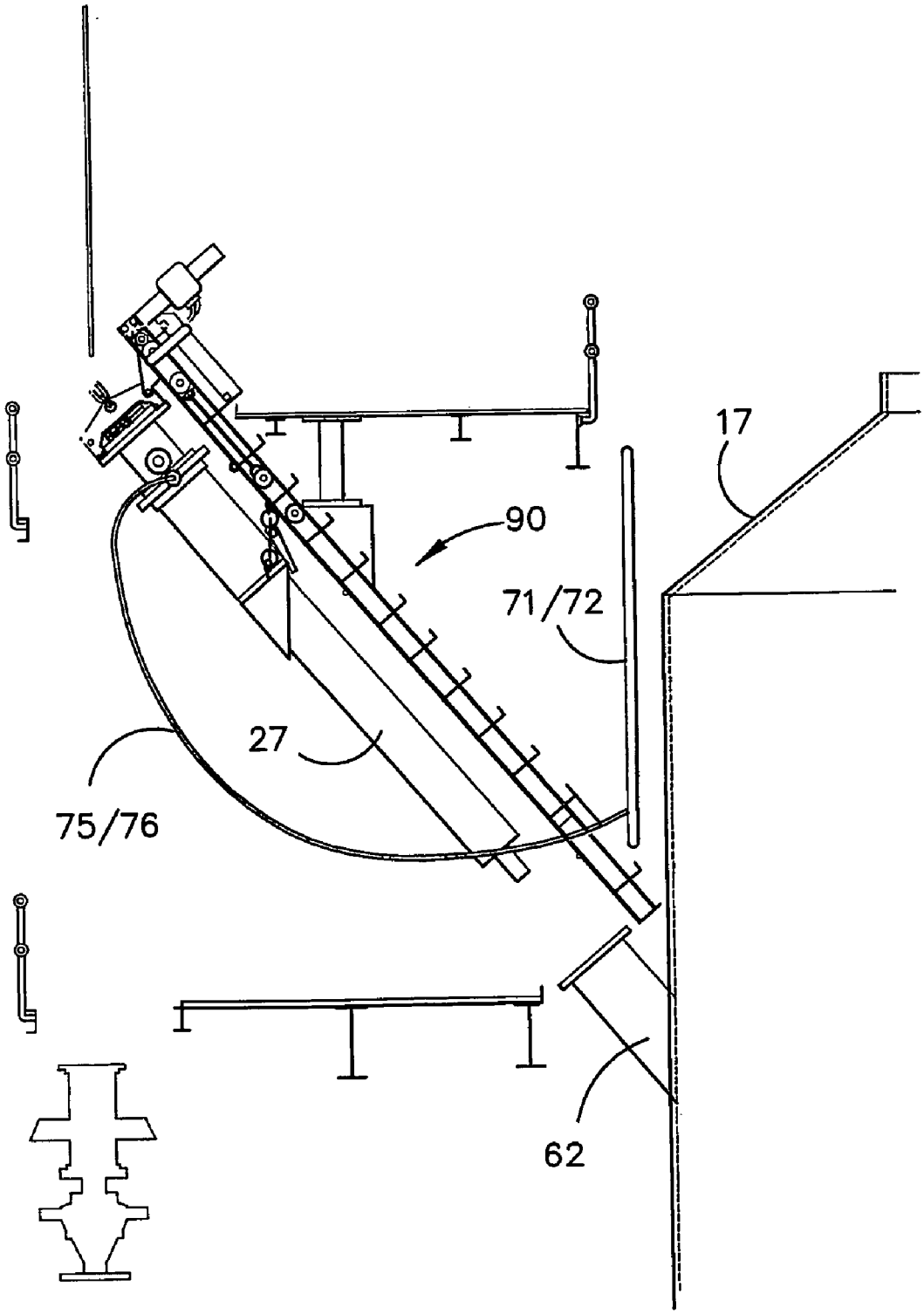
FIG. 8*c* illustrates the lance of FIG. 8*b* removed from the vessel whilst maintaining the supply of temporary cooling water.

Referring now to FIGS. 8*a*, 8*b* & 8*c* there is provided a pictorial representation of a smelt reduction vessel and a lance extending through an aperture in the vessel shell 17 and supported by lance mounting tube 62. A lance extraction and insertion hoist 90 extends upwardly and away from the vessel.

In FIG. 8*a* a solids conveyor 91, typically a pneumatic conveyor, connects to the end of the lance extending from the vessel. The conveyor extends upwardly and away from the vessel, parallel with the hoist. A segment 91*a* of the solids conveyor has been disconnected and is being removed.

In FIG. 8*b* a sufficient length of the solids conveyor has been disconnected from the lance to enable the lance to be extracted from the vessel. In the present embodiment the spool 30 of the solids conveyor has been removed, though other sections of the solids conveyor may be disconnect or removed in order to enable the spool and lance to be removed as a unit.

In FIGS. 8*a*, 8*b* and 8*c* the arrangement of one of the cooling water supply/return lines 71, 72 for the lance and one of the flexible hoses 75, 76 for the temporary flow of cooling water is shown pictorially. It will be appreciated that the arrangement is duplicated to provide both the supply and return flows in the manner illustrated in FIG. 6. Details of the physical layout of the supply and return lines 71, 72 and the connections of the flexible hoses 75, 76 are shown in FIG. 7.

In FIG. 8*c*, the lance has been extracted from the vessel by operation of the hoist. Further details on the hoist are provided in the applicants co-pending Australian patent specification AU2004904199 which is incorporated herein by reference. The hoses 75, 76 are of sufficient length that the lance can be extracted from the vessel by traversing the length of the hoist. In this way the lance can be extracted from the vessel by isolating and disconnecting a portion of the cooling water supply and return lines whilst maintaining a temporary supply of cooling water to the lance via a temporary hoses.

Although the illustrated lances are solids injection lances, the invention is not limited in application to such lances. The method could also be applied to the extraction and replacement of water cooled lances used for injecting gaseous material or a mixture of gas and solids into a metallurgical vessel, for example on injection of additives into slag within the vessel or the injection of air oxygen to promote a combustion process.

The invention claimed is:

1. A method of removing from a metallurgical vessel an internally water cooled injection lance to which material is supplied through an injection supply line to an outer end of the lance and to which cooling water is normally supplied from a cooling water circuit through a water supply line connected between the cooling water circuit and the lance and returned to the cooling water circuit via a return line connected between the lance and the cooling water circuit, comprising the steps of:

connecting a first flexible hose between a pair of water supply line connection locations spaced along the water supply line and establishing a flow of cooling water through that hose to the lance which bypasses a segment of the water supply line between said connection locations, connecting a second flexible hose between return line connection locations spaced along the return line to establish a return flow of water from the lance which bypasses a segment of the return line between the return line connection locations, isolating at least a part of each of said segments of the water supply line and the return line from both the cooling water circuit and the lance, disconnecting at least a portion of the isolated parts of the water supply line and the return line, disconnecting at least a portion of the injection supply line, and removing the lance from the vessel while maintaining the flow of cooling water through the lance via the flexible hoses.

2. A method as claimed in claim 1, wherein at least a portion of the segments disconnected from the water supply and return lines are removed.

3. A method as claimed in claim 1, wherein at least a portion of the injection supply line is removed.

4. A method as claimed in claim 3, wherein the delivery end of the injection supply line is disconnected and removed from the lance.

5. A method as claimed in claim 1, wherein there are ancillary water flow connections to the lance end the delivery end, or both the lance end and the delivery end of the injection supply line and the method includes the step of disconnecting one or more of those connections to permit withdrawal of the lance.

6. A method as claimed in claim 5, wherein there are connections for flow of cooling water to a lance mounting flange by which the lance is mounted on the vessel and this is disconnected prior to withdrawal of the lance.

7. A method as claimed in claim 1, wherein ancillary water flow connections extend between main sections of the water supply and return lines and form at least one sub-circuit for supply of cooling water to cooling circuits of the lance.

8. A method as claimed in claim 7, wherein at least one sub-circuit forms a sub-assembly connected to the lance.

9. A method as claimed in claim 8, wherein said sub-assembly connected to the lance is self-supporting on the lance.

10. A method as claimed in claim 1, wherein the main sections of the water supply and return lines locate isolation valves which in use operate to isolate the at least one sub-circuit from the supply and return lines.

11. A method as claimed in claim 10, wherein the water supply and return lines and the at least one sub-circuit are adapted to receive and locate hoses on either side of the isolation valves whereby in use temporary cooling water bypasses the isolation valves and is supplied to the at least one sub-circuit.

12. A method as claimed in claim 1, wherein there is a water flow connection for supply of water to a flange connecting the delivery end of the injection supply line to the upper end of the lance and this is disconnected prior to withdrawal of the lance.

13. A method as claimed in claim 1, wherein there is a purge gas connector for admission of purge gas into the lance for flow between a central core tube and an annular cooling jacket of the lance and the purge gas connector is disconnected prior to removal of the lance.

14. A method as claimed in claim 1, wherein the lance is a solids injection lance and the injection supply line is a solids conveyor.

15. A method of removing from a metallurgical vessel and replacing an injection lance to which material is supplied by use of the lance through an injection supply line to outer end of the lance and to which cooling water is normally supplied from a cooling water circuit through a water supply line connected between the cooling circuit and the lance and returned to the cooling water circuit via a return line connected between the lance and the cooling water circuit, wherein the lance is removed from the vessel by a method as claimed in any one of claims 1 to 13 and is replaced by the steps of establishing a flow of cooling water to the replacement lance through said flexible hoses, inserting the lance into the vessel, reinstalling the isolated parts of the supply line and the return line and de-isolating those parts to establish a flow of cooling water through those parts of the supply and return lines, and disconnecting the flexible hoses.

16. A method as claimed in claim 15, wherein the lance is a solids injection lance and the injection supply line is a solids conveyor.

* * * * *